United States Patent [19]

Wiercinski

[11] Patent Number: 4,865,231

[45] Date of Patent: Sep. 12, 1989

[54] BUTTON TYPE DISPENSING PACKAGE

[75] Inventor: Thomas A. Wiercinski, Erie, Pa.

[73] Assignee: The Procter & Gamble Company, Cincinnati, Ohio

[21] Appl. No.: 109,147

[22] Filed: Oct. 15, 1987

[51] Int. Cl.[4] ..... B67D 5/42

[52] U.S. Cl. ..... 222/390; 222/391; 401/173

[58] Field of Search ..... 222/390, 391, 386, 375, 222/388; 401/172–174; 74/129, 578

[56] References Cited

U.S. PATENT DOCUMENTS

| | | | |
|---|---|---|---|
| 1,553,305 | 9/1925 | Broadwell | 222/390 X |
| 1,663,338 | 3/1928 | Gagne | 222/390 |
| 1,803,524 | 5/1931 | Davis | 222/390 X |
| 2,080,343 | 2/1936 | Smith | 222/390 X |
| 2,913,151 | 11/1959 | Wiseman et al. | 401/174 X |
| 3,104,031 | 9/1903 | Wagner | 222/80 |
| 3,108,479 | 10/1963 | Norgaard | 73/481 |
| 4,013,370 | 3/1977 | Gingras | 401/175 |
| 4,323,176 | 4/1982 | Sartain | 222/326 |
| 4,658,993 | 4/1987 | Ulasich | 222/390 |
| 4,702,398 | 10/1987 | Seager | 222/386 |

FOREIGN PATENT DOCUMENTS

| | | | |
|---|---|---|---|
| 2146612 | 4/1985 | United Kingdom | 222/390 |

*Primary Examiner*—Joseph J. Rolla
*Assistant Examiner*—Boris Milef
*Attorney, Agent, or Firm*—Larry L. Huston; John V. Gorman; Richard C. Witte

[57] ABSTRACT

A swivel-up type dispensing package is disclosed. The package includes a product chamber with an elevator therein to move the product axially. A feed screw and nut are associated with the elevator and relative rotary motion between the feed screw and nut serve to move the elevator axially. The package also includes a button adapted to be depressed by the user in a direction which is generally transverse to the axis of body of the dispensing package. The transverse movement of the button is converted to rotary input to either the feed screw or nut to cause one to rotate relative the other and thereby move the elevator. In the described embodiment the button has an integral pawl which during the transverse movement engages ratchet teeth affixed to a wheel mounted perpendicularly to the axis of the body, causing the wheel to rotate through an arc subtended by driven teeth. The wheel rotates relative to a non-rotatable feed screw threaded through the bore of the wheel, causing the feed screw to advance in an axial direction. Affixed to the top of the feed screw is an elevator which is congruent to a chamber holding the product. By axially moving the elevator into the charge of product, it is moved to the applicating position of the dispensing package. The dispensing package is well suited to contain and dispense cream or solid stick deodorants and antiperspirants.

8 Claims, 2 Drawing Sheets

BUTTON TYPE DISPENSING PACKAGE

TECHNICAL FIELD OF THE INVENTION

This invention relates to swivel-up type dispensing packages and, more particularly, to swivel-up type packages used to apply deodorants or antiperspirants to the underarm.

BACKGROUND OF THE INVENTION

Dispensing packages in the present art have been used to dispense cosmetic cream or solid stick products to the axillae of the user. These packages typically have a tubular container body which holds the internal components and a charge of a cosmetic cream product, for example, which can be either an antiperspirant or a deodorant. The product is dispensed from an interior chamber located below the applicating surface through one or more orifices in the applicating surface due to the pressure exerted on the charge by an elevator. The elevator defines the bottom of the interior chamber which changes as the elevator axially moves towards the applicating surface. The elevator is usually advanced by a drive element which either rotates a feed screw or rotates with respect to a feed screw, causing the feed screw to advance. The feed screw, or a nut engaged with the feed screw, is affixed to the underside of the elevator, causing the elevator to advance and impel or extrude the cosmetic product through the orifices. As long as the drive element is rotated, product will be dispensed at a uniform rate in a generally continuous fashion.

When a cream product is dispensed at a uniform rate, the user may not be able to visually judge the proper amount of deodorant or antiperspirant which should be applied to each underarm, much less dispense this amount on an ephemeral basis with any degree of precision. Applying too much deodorant results in product waste and staining of clothes, while applying too little deodorant prevents efficacious results from being obtained. Furthermore, when too much product is used at one time, excess product will remain on the applicating surface creating a soiled and messy appearance.

Dispensers normally require two-handed operation, one hand to hold the body of the container, and one hand to rotate the hand wheel with respect to the body. This makes it inconvenient to dispense additional product when holding the dispenser near the axillae. It is even more difficult to use the dispenser to apply deodorant or antiperspirant products to the axillae while wearing clothing, if two-handed operation is required.

BRIEF SUMMARY OF THE INVENTION

It is an object of this invention to obviate the aforementioned problems related to uniform rate dosing of the product contained by the dispensing package and to two-handed operation of the dispenser being required. It is also an object of this invention to provide a dispensing package which is convenient to use while applying generally consistent amounts of a deodorant or antiperspirant product on an ephemeral basis.

In accordance with one aspect of the present invention there is provided a swivel-up type dispensing package comprising a container body, a movable elevator, a feed screw and nut combination, an outwardly biased push button and a means which convert the motion of the button into relative rotation between the nut and feed screw. The container body has an interior product chamber which contains the product and has a lengthwise extending central axis. The cross section of the product chamber is generally uniform along its length. Within the product chamber is an elevator which can move axially within the chamber, but not rotate with respect to the container body. Aligned with the axis of the product chamber is a feed screw having exterior threads. An internally threaded nut is aligned with the feed screw and threaded thereon. Either the feed screw or the nut is rotatable, while the other is not rotatable with respect to the container body. The arrangement is such that relative rotation between the nut and the feed screw which causes the elevator to axially move within the chamber. Mounted in the container body is an outwardly biased button which is adapted to be depressed by the user in a direction generally transverse the axis of the chamber. Means are provided to convert the transverse motion of the button into relative rotation between the nut and the feed screw thereby causing the elevator to move.

BRIEF DESCRIPTION OF THE DRAWINGS

While the specification concludes with claims particularly pointing out and distinctly claiming the present invention, it is believed that the same will be understood from the following description taken in conjunction with the accompanying drawings wherein like parts will be given the same reference number in the different figures and similar or analogous positions of parts are designated by applying a prime symbol to the number:

DETAILED DESCRIPTION OF THE INVENTION

Figure 1:
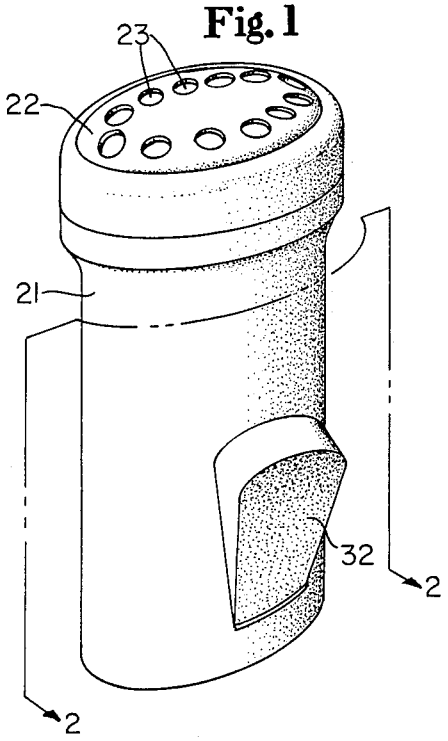
FIG. 1 is a perspective view of an embodiment of the dispensing package of the present invention employing a push button to effect dispensing.

The swivel-up dispensing package, as illustrated in FIG. 1, is intended to dispense a cream-type product, but the drive arrangement would be equally applicable for dispensing solid sticks. The package has a body 21 preferably made of an injection molded homopolymer polypropylene or other suitable material. The size should allow the dispenser to be conveniently held by the user yet large enough to accommodate the internal components discussed below and the desired charge of the cream product to be dispensed. The body must also be sturdy enough to provide a frame to hold the components discussed below in the described relationship.

Figure 2:
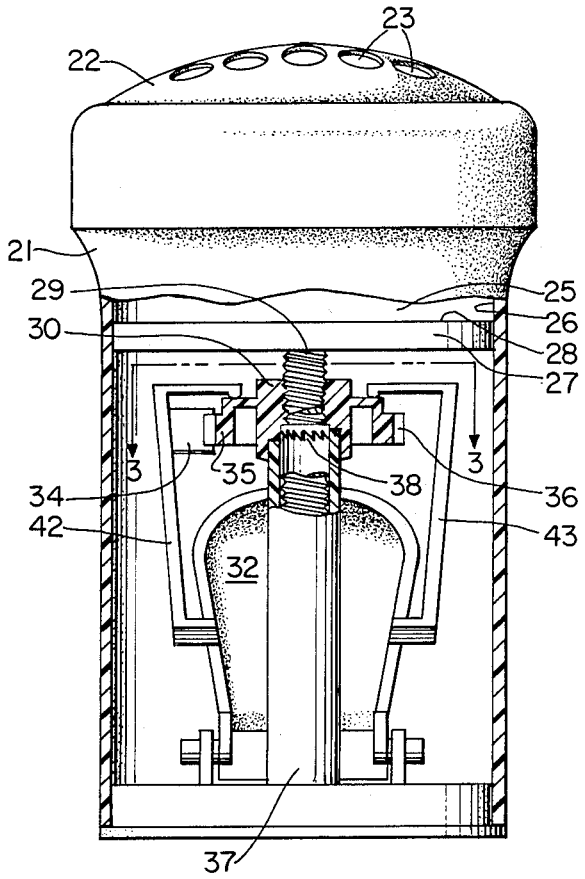
FIG. 2 is an enlarged side elevational view, partially in vertical section, taken along line 2—2 of FIG. 1.

When the body 21 is held in the normal or upright position, the axis of the body 21 is vertical as illustrated by FIGS. 1 and 2. At the top of the body 21 is an injection molded polypropylene applicating surface 22 which forms the outer end of the container body and serves two functions. First, if the cream product is dispensed by contact with the surface to which it is applied, the applicating surface 22 provides for a uniform distribution of the product without an excessive or wasteful amount being applied. Also, the surface protects the product from external contamination when the dispenser is not in use. The container body 21 and the wall forming the applicating surface 22 can be approximately 1.4 to 1.7 mm (0.055 to 0.065 inches) in thickness.

The applicating surface 22 may be generally flat, arcuate or any shape judged advantageous for applying the product in the desired manner. The shape illustrated in FIG. 1 has an applicating surface 22 with a compound curvature having approximate radii of 21 mm and 5.75 cm (0.84 and 2.65 inches). The shape fits well with the axillae when applying cosmetic cream products. The applicating surface 22 has one or more orifices 23 positioned therein which allow the product to be conveyed from an interior product chamber to the desired surface. The size, number, and distribution of the orifices 23 must be considered along with the shape of the applicating surface and material properties of the cream product being dispensed to ensure proper application will result. Twelve orifices 23 having a diameter of 43.2 mm (0.170 inches) provides for an even distribution of the cream product, if the orifices 23, are distributed across the applicating surface 22 in a fairly uniform manner.

Below the applicating surface 22, the product is held in an interior chamber 25 as illustrated by FIG. 2. The sides 26 of the chamber 25 may be formed by the interior surface of the container body 21, as shown in FIG. 2, or can be a separate cavity within the body. The bottom of the chamber is defined by the position of an injection molded polypropylene elevator 27 mounted generally perpendicular to the axis of chamber 25, as the elevator moves towards the applicating surface 22. It is important to prevent leakage of the product from the interior chamber 25, prior to the first use of the dispensing package and between subsequent usages. Therefore, seals should be provided at the junctures between the interior chamber 25 and the applicating surface 22 and the interior chamber 25 and the elevator 27. Alternatively, the product chamber 25 and applicating surface 22 can be molded as a unit, preventing leakage at this juncture. If any other seams or leakage paths are present as a result of the manufacturing process, seals should also be provided at these locations.

The volume of the interior chamber 25 is the product of its cross sectional area and the effective distance between the elevator 27 and the applicating surface 22. This volume should be sufficient to accommodate the total amount of product to be contained when the elevator 27 is in its initial or lowermost position. A chamber 25 having a cross-sectional area of approximately 11 square centimeters (1.7 square inches) and an axial length of 43 mm (1.69 inches) is sufficient to accommodate 42.5 grams (1.5 ounces) of a typical cosmetic cream product.

The elevator 27 is slidable within and tightly fitted to the sides 26 of interior chamber 25, having a cross section that is congruent thereto. It is necessary that the fit of the elevator 27 to the interior chamber 25 be tight enough to accommodate the sealing means discussed above, but not so tight as to require excessive force to overcome the friction between the elevator 27 and interior chamber sides 26, or difficulty will be encountered when trying to move the elevator 27 towards or away from the applicating surface 22. The proper tolerances can be maintained if the elevator 27 and feed screw 29 are made from injection molded polypropylene. To accommodate the preferred drive means discussed below, it is necessary that the elevator 27 not rotate with respect to the container body 21. This objective can be accomplished if the cross sections of the elevator 27 and interior chamber 25 are noncircular. While the upper surface 28 of the elevator 27 shown in the drawings is planar, it is preferred that it be shaped to conform to the underside of the wall on which the applicating surface is formed so that virtually all product is dispensed when the elevator is advanced to the top of chamber 25.

Although not shown on the drawings, either grooves or ribs may be placed near the bottom of sides 26 adjacent to elevator 27 to facilitate package filling. The grooves provide a vent channel for air displaced when filling chamber 25 with the product. Similarly, the ribs radially deform elevator 27, allowing air to be vented during product fill. After filling is completed, the elevator 27 may be moved upwards to an elevation above the grooves or ribs to restore the seal with the sides 26 of chamber 25.

To drive the elevator 27 from its initial position towards the applicating surface 22, a feed screw 29 is perpendicularly affixed to the underside of the elevator 27 such that the feed screw is aligned with the lengthwise central axis of the dispensing package. The feed screw 29 is also made of injection molded polypropylene and can have a 20° to 30° angle triple lead thread with a pitch of 16 threads per 26 mm 1.0 inch). The length of the feed screw 29 should correspond to at least the axial dimension of the interior product chamber. The diameter of the feed screw 31, is not critical, and can range from 5.8 to 17.3 mm (0.230 to 0.680 inches). If the dispensing package is to be filled by injecting the product through a hollow feed screw, a diameter near the upper end of the range is desirable, and a plug can be inserted in the bottom of the hollow feed screw to prevent subsequent loss of the product.

The elevator 27 and feed screw 29 are preferably integrally molded to prevent rotation of the feed screw 29 relative to the elevator 27. Since the elevator 27 is nonrotatable with respect to the container body 21, the feed screw 29 is similarly nonrotatable. The feed screw 29 is advanced in the forward axial direction by the relative rotation of an internally threaded nut or hub 30 of wheel 35, which hub is threaded onto feed screw 29 and aligned with the feed screw 29 along the axis of the body 21.

When manually depressed by the user, an injection molded acetal button 32 pivots about its lower fixed end, causing the upper free end to move towards the drive means. The button 32 has two horizontally oriented integral trunnions which fit into coacting stationary mounts, affixed to the base of container body 21. The upper part of the button 32 then pivots about the trunnions when depressed by the user. The base of the container body 21 may be attached to the side walls by a snap lock, annular beading or other conventional means. The base of the container is also injection molded polypropylene, having a wall thickness similar to that of the container body.

Instead of locating the pivot point at the lower end of button 32, the pivot point can be positioned at the side or top of button 32. The button 32 can still be depressed by the user in a direction which is transverse the axis of container body 21, and the pawl 34, to be described hereinafter, can be adapted to engage the wheel 35 in a generally tangential direction. Alternatively, the button 32 can be made to translate perpendicular to the axis of the container body 21, so long as pawl 34 engages wheel 35 in a generally tangential direction. The button 32 is spring loaded so that it will return to position 33 when released by the user. The geometry permits a wire-wound helical spring (not shown) to be inserted between the button 32 and a support in the interior of the dispensing package. The maximum spring force when button 32 is fully depressed desirably does not exceed 22.2 Newtons (5 pounds).

Figure 3:
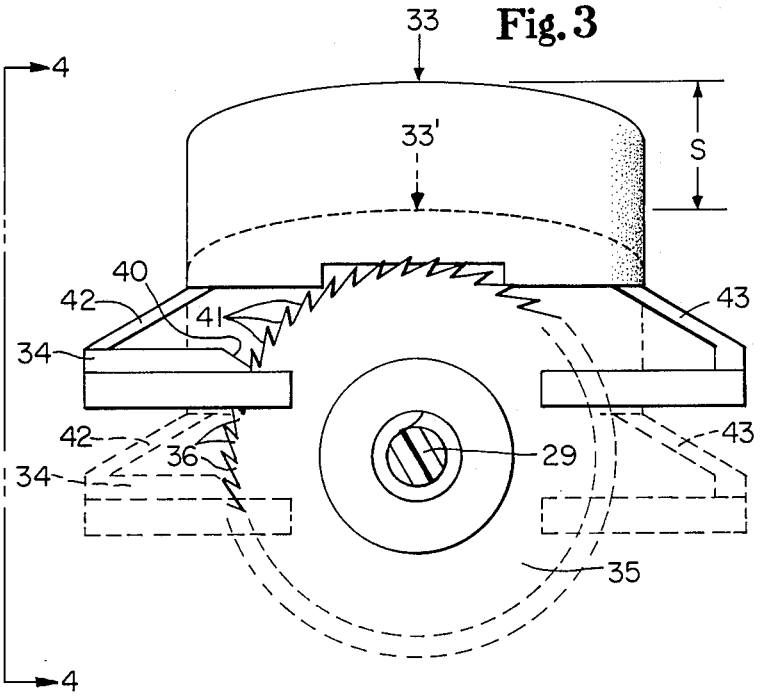
FIG. 3 is a horizontal sectional plan view of the button drive mechanism taken along line 3—3 of FIG. 2, with the button being in the outwardly biased position, the depressed button position showing in phantom.

As the button 32 is depressed and released, an integral pawl 34 moves inwardly and outwardly adjacent the periphery of wheel 35, through an arc or stroke S, as shown in FIG. 3. The wheel 35 is rotatable and perpendicular to the feed screw 29 and the lengthwise axis of the dispensing package. A plurality of one way ratchet teeth 36 are rigidly affixed to the circumference of the wheel 35. The wheel is preferentially made of injection molded acetal, although polypropylene has been found to be acceptable, and has a diameter of approximately 26 mm (1.0 inch) and 20 to 30, preferably 26, ratchet teeth with faces ranging from 1.02 to 1.91 mm (0.040 to 0.075 inches) in the radial direction. When button 32 is pushed inwardly, the integral pawl 34 engages one of the ratchet teeth 36 imparting a force to the wheel 35 in a generally tangential direction, rotating the wheel 35 an arcuate amount dependent on the size of the wheel 35, the stroke S of the button from position 33 to position 33', and radial placement of the pawl 34.

The wheel 35 is horizontally mounted on a stationary vertical post 37, which telescopes within an axial counterbore in the bottom of hub 30 and allows the wheel 35 to rotate about its own center. The axial counterbore provides stability for the wheel 35 to float in the axial direction without falling off vertical post 37. The vertical post 37 is stationary relative to the container body 21, and in alignment with the lengthwise axis and feed screw 29. The post may be integrally molded with the polypropylene base, or attached to the sides of the container body 21, such that there is no interference with the drive means.

The top of the post is preferentially fitted with saw-tooth or V-shaped anti-rotation teeth 38 which react against similar teeth 39 formed within the counterbore and oriented in the nonengaging direction, to prevent reverse cycling of the wheel 35 when the button 32 is released. The interaction of the teeth 38 and 39 reciprocates the wheel 35, and therefore the elevator 27, in the axial direction. This motion, when superimposed on the axial advance of the elevator caused by the relative rotation between the nut 30 and feed screw 29, provides beneficial pressure relief.

As described above, the feed screw 29 and elevator 27 are not rotatable relative to the container body 21 of the dispensing package. Therefore, when the feed screw 29 is threadably inserted through the threaded bore of the hub 30 of wheel 35, rotation of the wheel 35 relative to the feed screw 29 will cause axial movement of the feed screw 29 and elevator 27 in a direction determined by the hand of the lead angle of the screw threads.

Figure 4:
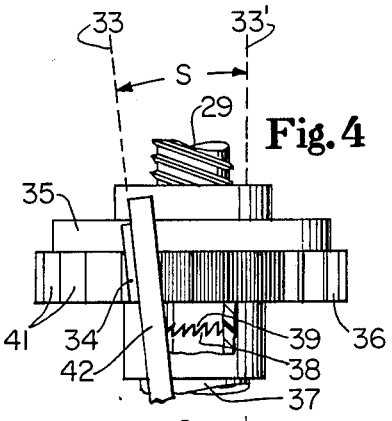
FIG. 4 is a fragmentary vertical view taken along line 4—4 of FIG. 3, showing portions of the drive and reciprocation mechanism when the button is in the outwardly biased position.
Figure 5:
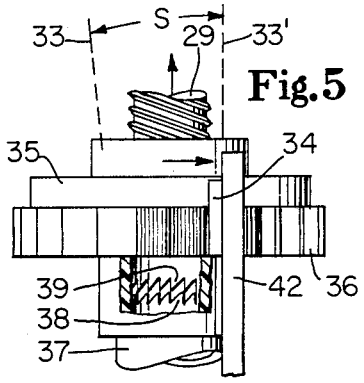
FIG. 5 is a fragmentary vertical view, similar to FIG. 4, when the button is in the depressed position and the elevator in the forward end of its cycle immediately prior to retraction.

Referring to FIGS. 4 and 5, in operation, as the button 32 is depressed by the user, the wheel 35 rotates through an arc subtended by the travel of the driven ratchet tooth due to the action of the pawl 34 on the tooth. By being rigidly affixed to the nonrotatable elevator 27, the feed screw 29 is held nonrotatable relative to the body 21. The relative rotation between the internal threads of the wheel 35 and the external threads of the feed screw 29 causes the screw to move a predetermined distance in an axial direction. The feed screw 29 is directly linked to the elevator 27, causing it to undergo an identical axial displacement, which action eventually expels the product through the orifice 23 in the applicating surface 22.

It is necessary that the subsequent driven ratchet tooth 36 be positioned close enough to the adjacent prior driven tooth 36 that the pawl 34 will move the subsequent tooth 36 into position after the forward stroke S from position 33 to position 33', nonengaging slide past the subsequent tooth on the return stroke S from position 33' to position 33, then engage this tooth on the next forward stroke S. Also, the angles of back face 40 of the pawl 34 and of the back face 41 of the teeth 36 must allow the pawl 34 to slide over the teeth when the button 32 returns to its starting position 33. By repeatedly depressing the button 32, and engaging a new driven tooth each time the button 32 is depressed, the wheel 35 can be rotated through a sufficient number of turns to ultimately advance the feed screw 29 and elevator 27 to the wall on which the applicating surface 22 is located. The number of teeth 36 and lead angle of the feed screw 29 can be advantageously adapted to provide a desired dose of product for a given cross-sectional interior chamber.

The support member 42 holding the pawl 34 is advantageously designed to accommodate the preferred motion of the pawl 34. If the member 42 has a rectangular cross section oriented with the longer side facing the wheel 35 and the shorter side aligned radially with the wheel 35, the member 42 will easily bend in the radial direction. By bending away from the wheel 35, the member 42 more easily accommodates the return stroke from position 33' to position 33, as the button 32 and pawl 34 move past the subsequent ratchet teeth. The longer side of the rectangle is designed to ensure sufficient torsional rigidity of the member 42. A resilient support member, having a cross section with the shorter side ranging from 1.1 to 2.0 mm (0.045 to 0.080 inches) and the longer side of 7.0 mm (0.275 inches) has been found to work well. The resilient member 42 is affixed to the button 32 at an attachment point noncoplanar of wheel 35 and can be made integral with the button by injection molding both pieces as a single unit, made of acetal. It is helpful to include a spring which biases the wheel 35 against the stationary post 37 to prevent the anti-rotation teeth 39 on the wheel 35 from separating away from the coacting teeth 38 on the stationary post 37. In the preferred embodiment, the member 42 holding the pawl 34 also serves as a tensioned spring clip, shaped like an inverted "L" which extends from the side of button 32 and which bears downward against the upper face of wheel 35, preventing separation of the wheel 35 from the vertical post 37 on which the wheel 35 is mounted.

A second member 43 provides an oppositely disposed spring clip to equally load each side of the wheel, with or without a pawl as desired. The total spring force can be within the range of 1.3 to 8.9 Newtons (0.3 to 2.0 pounds) as the ratchet wheel 35 is rotated over the anti-rotation teeth 38. If the second spring clip 44 has a pawl, the ratchet wheel 35 is driven through a double rotation each time the button 32 is depressed, providing the button return spring overcomes the torsional resistance in the drive system.

The faces of the ratchet teeth 36 and pawl 34 can be oriented angularly with respect to the axis of feed screw 29 so that the force imparted to the teeth 36 has a tangential component and a component parallel to the axis of the feed screw 29. The tangential component serves the function of imparting torque to the wheel 35, while the component in the axial direction can be used to reduce the torque required to provide the reciprocation due to interaction of teeth 38 and 39 by displacing the wheel 35 in the forward axial direction. This feature becomes more desirable as the anti-rotation teeth 38 are enlarged.

Since the wheel 35 is rotated on an intermittent basis as the button 32 is depressed, the feed screw 29 and elevator 27 will be similarly advanced on an intermittent basis. This causes the product to be dispensed in discrete doses corresponding with the intermittent movements of the elevator 27. By advantageously adapting the angle of lead screw 29, the diameter of the circle in which the ratchet teeth 36 are placed and the stroke of the button 32, the dispensing package will accurately and repeatedly dispense a given dose size.

Since actual dispensing of product only occurs during a relatively small part of the cycle, due to the axial reciprocation noted previously, the user is discouraged from trying to dispense a partial dose. The size of the dose can be adjusted such that the user does not obtain an amount of the product which is too small to yield efficacious results. Furthermore, the dispenser is easily adapted to effective use since the user may be instructed, or judge for himself, that the proper dose is obtained only by depressing the button 32 a certain number of times; for example, three times. The user can therefore quickly and precisely obtain this dose through the simple action of depressing the button 32 the required three times. Each time the button 32 is depressed, the return action of the wheel 35 against the anti-rotation teeth 38 creates an audible and tactile "click" which the user can associate with a certain amount of the product having been dispensed.

It should be recognized that a variety of related drive means are known to advance the elevator of swivel-up dispensing packages. These rely on relative motion between a feed screw and a nut in the package. Either can be rotated to provide the movement of the elevator, depending on the arrangement. A family of mechanisms could be constructed having a non-rotating nut and rotating feed screw. For example, the nut can be nonrotatably associated with the elevator and an axially affixed feed screw rotated, or the nut could be mounted in fixed relationship with the package body and a feed screw, rotatably affixed to the elevator, turned to effect dispensing. Alternatively, a family of other mechanisms can be constructed having a rotating nut and non-rotating feed screws, one of which is the described embodiment. So long as relative rotation between the nut and feed screw is maintained, either family of mechanisms would be a feasible drive means for the dispensing package.

Depending on the elevator drive arrangement, the means to convert transverse movement of the button into relative rotary movement between the feed screw and nut can be arranged to suit. For example, where the nut is affixed to the elevator and an axially affixed feed screw is made rotatable, the feed screw could be made integral with the ratchet wheel as opposed to being threadably engaged. Thus, if the pawl directly imparts the force to a rotating feed screw which is threaded through a stationary nut, the feed screw will have one threaded part, and a second part with ratchet teeth having an axial length equivalent to the total travel of the elevator. Obviously, right or left hand screw threads should be employed as necessary to cause the feed screw 29 and elevator 27 to advance towards the applicating surface 22.

It should also be recognized that analogous rack and gear type drives could be substituted for the above described pawl and ratchet arrangement without departing from the spirit and scope of the present invention.

What is claimed is:

1. A swivel-up dispensing package comprising:

(a) a container body having an interior product chamber of generally uniform cross section with a lengthwise-extending central axis;

(b) an elevator having a cross section congruent to and mounted for axial movement within said chamber, said elevator being nonrotatable relative to the container body;

(c) a feed screw aligned with the axis of the chamber, said feed screw having exterior threads, and a nut aligned with said feed screw and having internal threads adapted to engage with the exterior threads of the feed screw, one of said feed screw and said nut being non-rotatable relative the container body and the other being rotatable, the arrangement being such that relative rotary movement between the two causes the elevator to move axially;

(d) an outwardly biased button mounted in said container body and adapted to be manually depressed in a radial direction generally transverse the axis of said chamber and to return to the outwardly biased position;

(e) an axially rotatable wheel associated with the said other end of said feed screw and nut, said wheel having a plurality of ratchet teeth disposed about its periphery;

(f) a resilient support member cantilevered from said button and having an integral pawl at the distal end of said member, said pawl being adapted to engage one of said ratchet teeth and cause rotation of said wheel as the button is depressed, said member being adapted to bend radially outwardly to permit the pawl to slide over said ratchet teeth as the button returns to the outwardly biased position; and (g) a means to bias the said other away from said elevator.

2. The package of claim 1 in which the wheel is axially fixed and the nut is the hub of the wheel which has a central bore in threaded engagement with the feed screw, the feed screw being non-rotatably affixed to the elevator.

3. A dispensing package according to claim 1 wherein said rotatable wheel has 20 to 30 ratchet teeth.

4. A dispensing package according to claim 1 wherein said resilient member is attached to said button at an attachment point generally noncoplanar of said wheel.

5. A dispensing package according to claim 1 further comprising a means to prevent rotation of the one of said feed screw and said nut which is rotatable, in a reverse direction.

6. A dispensing package according to claim 5 wherein said means to prevent rotation in a reverse direction comprises a plurality of anti-rotation teeth associated with said rotatable wheel and a plurality of stationary coacting teeth associated with said container body.

7. A dispensing package according to claim 1, wherein said resilient member is shaped like an inverted "L".

8. A dispensing package according to claim 7 further comprising a second resilient member oppositely disposed from said first resilient member on the other side of said rotatable wheel, said second member being shaped like an inverted "L" and substantially equally downwardly biasing said rotatable wheel.

* * * * *